US005357269A

United States Patent [19]

Zeltser

[11] Patent Number: 5,357,269

[45] Date of Patent: Oct. 18, 1994

[54] ELECTRICAL PRINT HEAD FOR THERMAL PRINTER

[75] Inventor: Alexander M. Zeltser, San Diego, Calif.

[73] Assignee: Eastman Kodak Company, Rochester, N.Y.

[21] Appl. No.: 891,015

[22] Filed: Jun. 1, 1992

[51] Int. Cl.[5] ..... B41J 2/335

[52] U.S. Cl. ..... 346/76 PH

[58] Field of Search ..... 346/76 PH; 400/120

[56] References Cited

U.S. PATENT DOCUMENTS

| | | | |
|---|---|---|---|
| 3,939,895 | 2/1976 | Sawyer | 164/60 |
| 4,232,213 | 11/1980 | Taguchi et al. | 219/216 |
| 4,296,309 | 10/1981 | Shinmi et al. | 219/216 |
| 4,343,986 | 8/1982 | Mitani et al. | 219/216 |
| 4,456,915 | 6/1984 | Crooks et al. | 346/76 PH |
| 4,777,583 | 10/1988 | Minami et al. | 346/76 PH |
| 4,781,113 | 11/1988 | Yamamoto et al. | 346/76 PH |
| 4,835,552 | 5/1989 | Akutsu et al. | 346/139 C |
| 4,907,015 | 3/1990 | Kaneko et al. | 346/76 PH |
| 4,950,043 | 8/1990 | Russom | 350/96.1 |
| 4,972,197 | 11/1990 | McCauley et al. | 343/704 |
| 4,973,988 | 10/1990 | Stephenson | 346/76 PH |
| 4,980,705 | 12/1990 | Akutsu et al. | 346/155 |
| 4,983,992 | 1/1991 | Nakazawa | 346/76 PH |
| 4,990,934 | 2/1991 | Takeuchi et al. | 346/76 PH |
| 5,028,938 | 7/1991 | Sofa et al. | 346/155 |
| 5,055,859 | 10/1991 | Wakabayashi | 346/76 PH |

FOREIGN PATENT DOCUMENTS

| | | |
|---|---|---|
| 0166269 | 12/1980 | Japan . |
| 0135081 | 10/1981 | Japan . |

OTHER PUBLICATIONS

Ditchek, "Preparation & Electrical Properties of a Directionally Solidified GE-$TiGe_2$ Eutectic", pp. 1961-1967, J. Appl. Physics, vol. 57(6), Mar. 15, 1985.

Ditchek et al., "Directional Solidification of Si and GaAs Based Eutectics for Electronic Applications", pp. 121-129, Solidification Processing of Eutectic Alloys, The Metallurgical Society, 1988.

"High Resolution Resistive Ribbon Printing for Typesetter Application", by Dove et al., pp. 7-10, Journal of Imaging Science, vol. 33, No. 1, Jan./Feb. 1989.

*Primary Examiner*—Benjamin R. Fuller
*Assistant Examiner*—N. Le
*Attorney, Agent, or Firm*—William F. Noval

[57] ABSTRACT

There is disclosed a multiple electrode print head for a thermal printer. The electrodes of the print head include metal-like conductive fibers electrically and physically isolated from each other in a relatively nonconductive matrix such as silicon. The fibers are grown in situ in the matrix as a minor phase of a eutectic of a suitable metal and the material of the matrix. A number of individual conductive fibers are electrically connected in common to form each of the electrodes of the head. This provides redundant electrical contact between each electrode and an electro-resistive ink donor element of the printer. Because of the very small sizes and spacings of the conductive fibers, electrodes, which each comprise a number of fibers, may be spaced along the length of the head on centers as close or closer than 1000 per inch. The fibers of each electrode and the matrix are relatively very hard and hence highly wear resistant. The fibers are grown in situ in the matrix by the Bridgman the Czochralski, or other crystal growth techniques. This makes manufacture of the print head highly precise and keeps cost relatively low.

17 Claims, 2 Drawing Sheets

ELECTRICAL PRINT HEAD FOR THERMAL PRINTER

FIELD OF THE INVENTION

This invention relates to an improved print head such as used in a resistive-ribbon n thermal-transfer printer, and more particularly, to such a head, and to a method of manufacture of the head, capable of printing at densities as high or higher than 1000 dots/inch.

BACKGROUND OF THE INVENTION

In resistive ribbon printing, an electrically conducting ribbon, termed a donor element, is contacted by a print head containing a row of small closely spaced electrodes. These electrodes are individually driven by respective electronic circuits to inject currents locally into the ribbon. The underside of the ribbon is coated with a suitable ink which, when the ribbon is locally heated by the currents applied to it by the print head, transfers small dots (pixels) of ink onto a receiver element such as a piece of paper. The pitch of the pixels of ink thus printed is determined by the spacings of the electrodes in the print head. The density of a printed pixel is controlled by the amount of ink transferred from the donor element to the receiver element. The amount of ink so transferred as a printed pixel is a function of the current (and the heating effect thereof) applied to the donor element by a respective electrode of the print head. Electrically conductive ink donor elements are commercially available.

The pitch of the ink pixels i printed on a receiver element is an important factor in determining the visual quality of an image thus printed. The finer the pitch of the pixels, the finer is the quality of the printed image. It is desirable for this reason to be able to print with a fine pitch, for example, greater than 300 dots per inch (DPI). However, pitches this fine or finer become increasingly more difficult to obtain because, among other things, of the very Close spacings required of the electrodes in the print head. For example, a 1000 DPI system requires that the head electrodes be spaced on one mil (25 micron) centers, and since the electrodes must also be insulated from each other, the actual size of each electrode has to be of the order of 16 microns square. It is difficult to manufacture, with the quality and precision required, electrodes that are this small. Moreover, since the electrodes must rub with a slight force against the dye donor element in order to make good electrical contact to it during printing of an image, the electrodes are gradually worn away. The rates at which the electrodes are worn are determined by such factors as the material of which they are made, the amount of pressure of the electrodes against the donor element, and the wear characteristics and sizes of the electrodes.

It is desirable to provide a print head for a thermal printer, such as described above, in which the individual electrodes of the head are ultra-small and which can be made with great precision at relatively low cost. It is further desirable that the electrodes be highly wear resistant and that they provide reliable electrical contact to a donor element during extended operation of the printer.

SUMMARY OF THE INVENTION

In accordance with one aspect of the invention, there is provided a print head for a thermal printer in which the electrical elements (electrodes) of the head consist of the ultra-miniature (e.g., micron size) metal-like conductive fibers in a relatively non-conductive matrix (e.g., silicon). The head structure is a body of material produced by directional solidification of eutectic or near eutectic Si-metal(Me) alloys, as will be described hereinafter, where Me, by way of example, is Ta or Zr. The head structure produced in this way consists of essentially parallel long thin fibers of metal-like $MeSi_2$ phase uniformly distributed in Si matrix phase. Such metal-like fibers by way of example have a volume resistivity in the range of 33 to 55 micro-ohm cm. The resistivity of the matrix is greater than about one ohm cm, and at each metallic-fiber/semiconductor-matrix interface a rectifying junction is formed with the result that the fibers are effectively electrically insulated laterally from each other by the matrix. The micro hardness of the $MeSi_2$ fibers, depending on the metal, is about 1050 to 1400 kg/mm$^2$ and that of a silicon matrix is about 1100 kg/mm$^2$. The average diameter of the fibers is usually 1 to 3 microns, and their average spacing is 3–8 microns, but in general these depend on the Me-Si eutectic system and growth conditions, in particular on growth velocity. A number of individual fibers are advantageously connected electrically in parallel with one another at each electrode position of the print head. By virtue of the ultra-miniature size and spacings of the fibers, a print head with an electrode pitch as fine or finer than 1000 DPI can be manufactured. The wear characteristics of this new head by virtue of the great hardness of the fibers (e.g., up to 1400 kg/mm$^2$) results in longer service life and more reliable operation as compared with previous print heads having such fine pitch. Moreover, because a number of fibers are electrically connected in parallel at each electrode position of the print head, considerable redundancy in the electrical contact to the electro-resistive donor element of a thermal printer at each print position is provided. Thus the degrading effects on a printed image of dirt and other causes of poor electrical contact are greatly reduced.

In accordance with another aspect of the invention, there is provided a method of manufacturing a print head having very closely spaced electrodes. The method utilizes a step of directionally growing materials of eutectic or nearly eutectic composition, which produces a structure of closely spaced metallic or intermetallic fibers in the insulating or semi-conducting matrix. Using suitable materials such as silicon and tantalum or zirconium, metal-like eutectic fibers (e.g., $TaSi_2$ or $ZrSi_2$) having a diameter of only 1–2 microns or so with a spacing of 3 to 8 microns, and a length of hundreds of microns are readily grown in the matrix using the Czochralski, the Bridgman or other processes. This will be described in greater detail hereinafter. After directional solidification, a rectangular piece of the eutectic material with the fibers oriented generally perpendicularly between a bottom and a top surface is cut to a suitable size and length. Then a $SiO_2$ insulating layer about 0.2 microns thick is formed by thermal oxidation of the top surface of the rectangular piece of eutectic material. Small vias ("windows") of the spacing and size corresponding to the desired DPI and electrode size are opened in the layer of $SiO_2$ by means of photolithographic and reactive-ion etching techniques. Next, cobalt is sputtered in the vias and then rapidly thermal annealed (RTA) to form $CoSi_2$ film which makes low resistance contact to the $MeSi_2$ fibers and high resistance rectifying contact/junction to the silicon matrix. Excess cobalt is etched off and aluminum interconnects running from the individual electrodes or tabs to the driver circuits are made using photolithographic and sputtering techniques. These processing techniques are routinely used in the semiconductor industry. Thus a group of the conductive fibers whose ends are exposed within each window are electrically commoned as a single electrode of the head. The opposite ends of the conductive fibers provide wear resistant, redundant electrical contacts to the electro-resistive donor element of the thermal printer at each small area where a pixel of ink is to be transferred onto the receiver element.

Viewed from another aspect, the present invention is directed to a method of forming ultra-fine closely spaced electrodes for a print head of a thermal printer. The method comprises the steps of directionally solidifying a suitable eutectic composition producing conducting metal-like fibers in essentially non-conducting matrix, finishing such a structure to size and length with a top surface generally orthogonal to the conducting fibers; and applying respective electrical connections for each electrode within small spaced apart areas to multiple ends of the conductors within the respective areas, the other ends of the conductors of each electrode being adapted to electrically contact an electro-resistive ink donor element such that redundant electrical contacts to the donor element are provided for each electrode.

Viewed from still another aspect, the present invention is directed to a print head having a body of relatively non-conductive matrix material, the body having a top surface, a bottom surface and a length. There are a plurality of thin closely spaced conductive members within the body arranged parallel to each other at suitable angles to the top and bottom surfaces of the body, and a plurality of small-area conductive tabs arranged in closely spaced relation along the lengths of the top surface of the body of the head. Respective ones of the tabs are connected to the upper ends of the conductive members within the area of the tab, the bottom ends of the members are adapted to contact an electro-resistive donor element lying against the bottom surface of the head body such that closely spaced electrodes of the print head are formed by multiple conductive members connected respectively to the conductive tabs.

The invention will be better understood from a consideration of the following detailed description taken in connection with the accompanying drawings and claims.

The drawings are not necessarily to scale.

DETAILED DESCRIPTION

Figure 1:
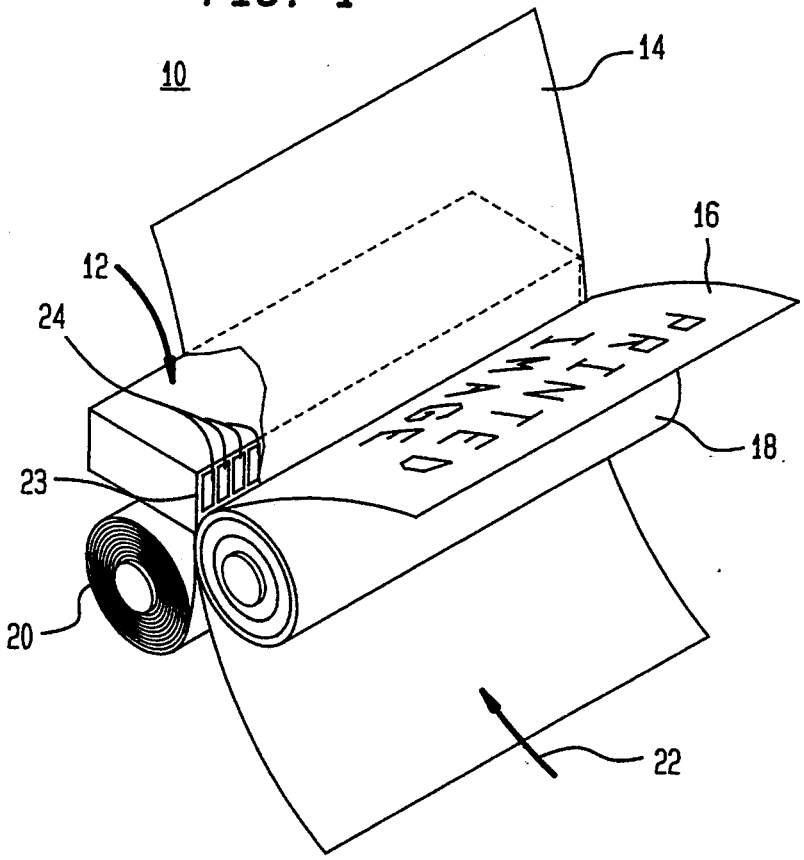
FIG. 1 is a schematic illustration of portions of a thermal printer in which the present invention has utility.

Referring now to FIG. 1, there is shown a thermal printer 10 in which the present invention has utility. The printer 10 comprises a print head 12, an electro-resistive ink donor element 14 (Shows, with a section removed), a receiver element 16 (shown with the words "Printed Image" thereon), and a drive roller 18. For the sake of illustration these elements are shown in somewhat exploded relation, but it is to be understood that the head 12 is held with suitable force against the donor element 14 and the receiver element 16 by the drive roller 18. The head 12 and the drive roller 18 are mounted on a frame (not shown). The donor element 14 is fed to the printer 10 from a supply roll 20. In operation of the printer 10, the donor element 14, and receiver element 16 are driven upward in the direction of an arrow 22 past the print head 12. The print head 12 has on a front face 23 thereof, which bears against the back of the donor element 14, a lateral row of very closely spaced electrodes 24. The electrodes 24 apply to the donor element 14 respective electric currents which, as is known in the art, cause minute pixels of ink to be transferred from the donor element 14 into the receiver element 16. In this way an image is printed on the receiver element 16. Electrical drive circuits (not shown) for the respective head electrodes 24 are well known in the art. Dye donor elements, such as the donor element 14, are commercially available. The fineness of the head electrodes 24, how closely they are spaced, and how reliably they contact the donor element 14 during operation of the printer 10, are important factors in obtaining printed images of high visual quality.

Figure 2:
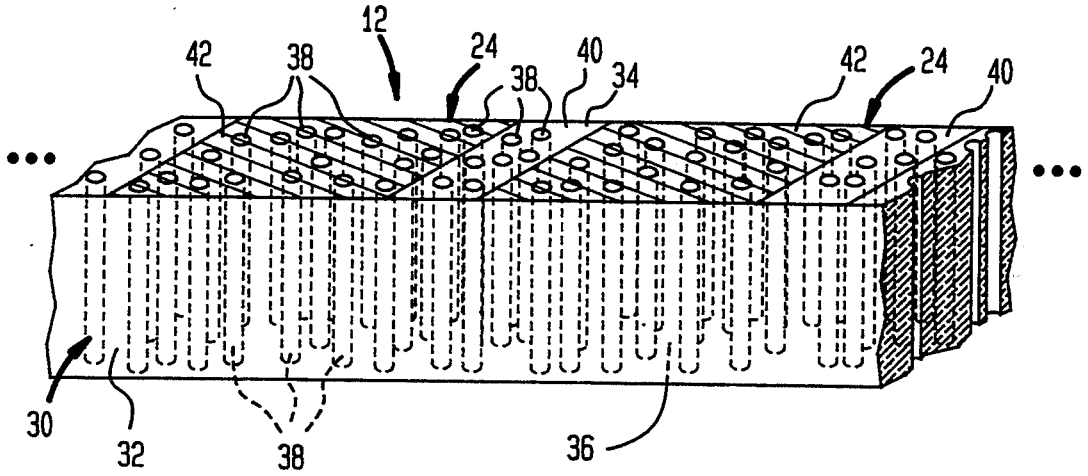
FIG. 2 is a greatly enlarged portion of a print head provided in accordance with the present invention and illustrates a step in accordance with the method of manufacture of the head.

Referring now to FIG. 2, there is shown, greatly enlarged and not to scale, a portion of the print head 12 of FIG. 1. The head 12 has a housing (not shown here) within which is mounted in suitable fashion a long rectangular body 30. Formed as an integral part of the body 30, in a way explained in detail hereinafter, are the closely spaced head electrodes 24. The body 30 is a solid bar of a relatively non-conductive matrix 32, having a top surface 34 and a bottom surface 36. Extending perpendicularly between these top and bottom surfaces 34 and 36 within the body 30 are a large number of very thin, closely spaced electrically conductive fibers 38 which are formed in situ, as will be explained shortly. These fibers 38 constitute the minor phase $MeSi_2$, which occupies approximately 2 to 19% of the volume of the eutectic $MeSi_2$-Si, depending whether Me is Ta or Zr. The volume between the fibers 38 is filled with Si, which constitutes an electrically insulating matrix 32 or the major phase of the $MeSi_2$-Si eutectic. The fibers 38, by way of example, are about one to three microns in diameter, and are closely spaced on centers of about 3 to 8 microns. The fibers 38 are reasonably uniformly distributed in the matrix. The fibers 38 are arranged in the matrix 32 generally parallel and not in physical contact with each other. The fibers 38 extend in length within the matrix generally at right angles to the top surface 34 and at a suitable angle to the bottom surface 36 of the body 30. The distance between these surfaces, by way of example, is 500 microns. The length of the body 30 is as long as needed for the print head 12 to span the width of the ink donor element 14 (FIG. 1). For convenience, if desired, a body 30 may be an inch long and a number of such bodies 30 may be stacked end-to-end to provide the full length of the print head 12. The spacing of the electrodes 24 within the body 30 may be as close or closer than 1000 per inch.

The fibers 38 are advantageously grown in situ in the matrix 32 by the Czochralski, the Bridgman, or other crystal growth techniques which are well known in the art. A more complete description of some of these techniques is given in an article entitled "Directional Solidification of Si- and Ga-As- Based Eutectics for Electronic Applications" by Ditchek, et al., pp. 121 to 129, in Solidification Processing of Eutectic Alloys, (Stefanescu, Abbaschian and Bayuzick), The Metallurgical Society (1988), and in an article entitled "Preparation and Electrical Properties of a Directionally Solidified Ge-$TiGe_2$ Eutectic" by Ditchek, pp. 1961–1967, J. Appl. Phys., Vol. 57 (6), 15 Mar. 1985. These articles describe the processes and conditions for growing rod-like eutectics.

After a boule of the eutectic material has been directionally solidified it is sliced into wafers of desired thickness (usually 500 microns) each one representing the body 30. Then the top surface 34 of the body 30 is covered with a thin insulating layer 40 (e.g., 0.2 micron thick) of $SiO_2$ as was described previously. Next, small windows 42 (indicated by the shaded areas) are etched in the insulating layer 40. These windows 42 (only two being shown), by way of example, are 16 microns square and are spaced on 25 micron centers along the length of the body 30. Exposed within each window 42 are the upper ends of respective ones of the fibers 38. The upper ends of other fibers 38 not within a window 42 remain covered by the remaining portion of the insulating layer 40. To provide an electrical connection to each of the fibers 38 within each window 42, a thin layer of metal (such as cobalt) is sputtered within the window 42 as was described previously. After RTA processing at 800° C. for 12 seconds the cobalt layer interacts with Si forming $CoSi_2$ which makes good electrical contact to the exposed ends of the fibers 38 within the window 42 (see description of FIG. 4). As a result a number of fibers are electrically connected in parallel within the area (e.g., 16 micron square) of each window 42. The actual number of fibers 38 so connected depends, of course, on the area of the window 42, and on the relative volume fraction of the fibers 38 and the matrix 32, which in turn depends on the eutectic system. Those fibers 38 connected together at their upper ends within the area of a window 42, have their lower ends exposed at the lower surface 36 of the body 30. These connected-together multiple fibers thus provide the respective head electrodes 24 of the print head 12. Each head electrode 24 is wear resistant and it makes multiple electrical contact (via fiber ends) to the dye donor element 14 (FIG. 1). Each electrode 24 is electrically isolated from a closely spaced adjacent electrode 24 by the relatively non-conducting insulating material of the matrix 32. The wear resistance combined with the redundance of the electrical contacts due to multiple fibers in the electrodes 24 of the print head 12 provided in accordance with the present invention result in improved operating quality and efficiency of the thermal printer 10 as compared with previous arrangements.

Figure 3:
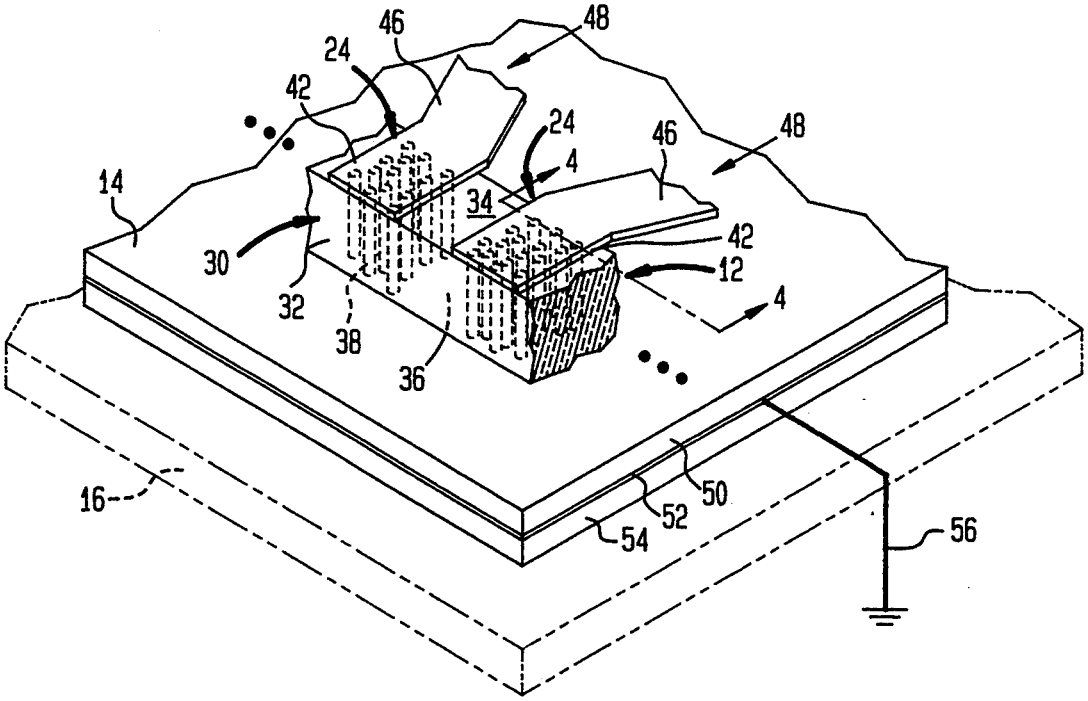
FIG. 3 is a schematic illustration in accordance with the present invention, of a portion of the print head provided according to the present invention and shows how elements of the print head are electrically connected and used with an electro-resistive donor element in a thermal printer.

Referring now to FIG. 3, there is shown, greatly enlarged and partially broken away, the print head 12 with its electrodes 24, and the dye donor element 14 of FIG. 1 which is shown with greater detail than in FIG. 1. The electrical connection of each electrode 24 to the drive circuitry is provided by a respective electrical connection 46 deposited on the top of the $CoSi_2$ thin layer formed as explained previously within each window 42 (FIG. 2). By way of example, these electrical connectors are aluminum metalization interconnects formed using standard sputtering and photolytographic techniques. The rear ends of the aluminum interconnects 46 are shown broken away, but it is to be understood that they extend as conductive printed circuit traces to drive circuitry (not shown) of the thermal printer 10. It is to be noted here that in order to better illustrate the separate yet close spacing of the electrodes 24 (only two being shown), those fibers 38 which are not connected to a respective tab 46 are not shown in FIG. 3 but in fact are present (though electrically inoperative) in the matrix 32. The body 30 of the print head 12 with its linear array of the closely spaced electrodes 24 has its lower surface 36 in contact with a top conductive polymer layer 50 of the donor element 14. This donor element 14, as is well known in the art, comprises a sandwich of the top conductive polymer layer 50, a thin aluminum ground layer 52, and a bottom thermoplastic ink layer 54. The bottom ink layer 54 of the donor element 14 is closely adjacent to the receiver element 16 (shown here in dotted outline). A pulse of electrical current, indicated by one of the arrows 48, is applied to a respective contact tab 46 and passes through the respective multiple fibers 38 of an electrode 24, into the conductive polymer layer 50, and hence through the aluminum ground layer 52 to a common ground connection 56. Each pulse of current 48 thus applied through a print head electrode 24 resistively heats the aluminum ground layer 52 in a small area locally beneath the respective electrode 24, due to high resistance of a thin native aluminum oxide layer $Al_2O_3$ always present on the aluminum surface. This heating causes a small dot or pixel of ink from the ink layer 54 to be "printed" onto the receiver element 16 at that location.

Figure 4:
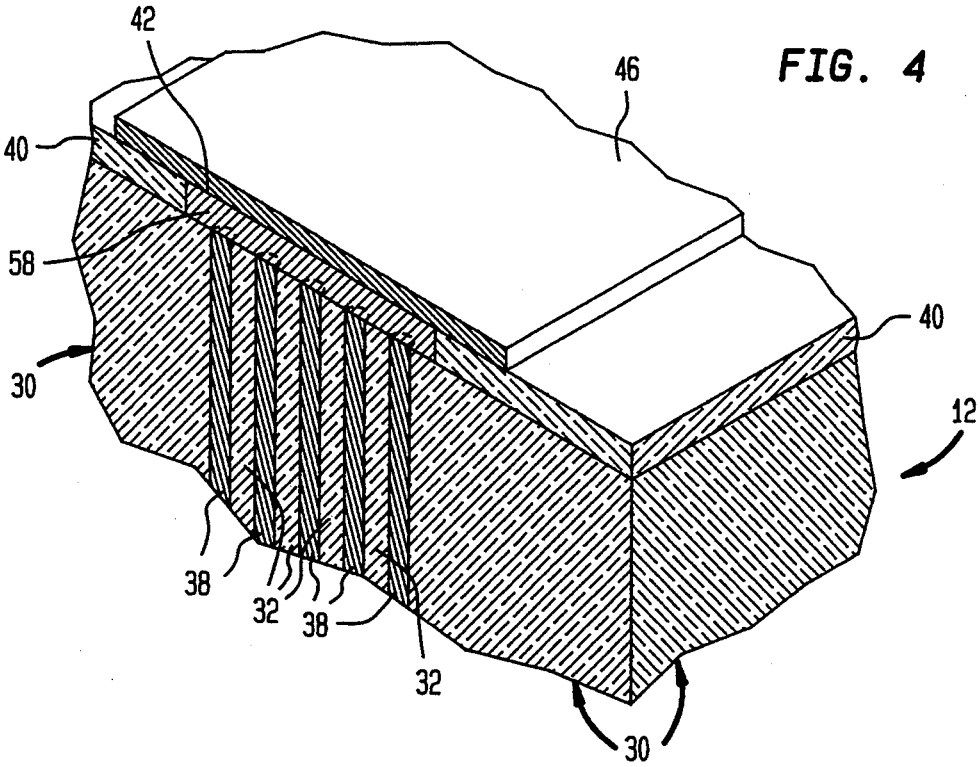
FIG. 4 is an enlarged cross-sectional view, partially in perspective and partially broken away, taken as indicated by the line 4—4 in FIG. 3.

Referring now to FIG. 4, there is shown an enlarged partial cross-section, taken as indicated by the line 4—4 in FIG. 3, of the print head 12. The body 30 contains a number of metal-like fibers 38 whose upper ends are exposed in the area of the window 42 which as previously explained has been etched in the thin insulator layer 40 of $SiO_2$. There is formed within the window 42 a thin conductive layer 58 of $CoSi_2$ (in the way previously described) which makes low resistance electrical contact to the exposed ends of the conductive fibers 38. Then formed in electrical contact with the conductive layer 58 are the aluminum interconnects. In those areas outside a window 42, each interconnect 46 is insulated by the layer 40 from other fibers 38 whose ends remain covered by the layer 40 and which for the sake of simplification are not shown here. After aluminum interconnects are formed the wafer is cut to proper size and Shape forming a body 30 of the head.

As explained previously, the bottom face 36 of the print head body 30 rubs with light force against the donor element 14 during operation of the printer 10. However, the electrodes 24 are wear resistant being composed of the multiple conductive fibers 38 supported within the matrix 32, both of which are relatively very 15 hard. Thus even though the electrodes 24 may be small in size (e.g., 16 microns square), the great hardness of the fibers 38 (e.g., up to 1400 kg/mm$^2$) and the fact that they can be made relatively long (e.g., 500 microns), means that the electrodes 24 have a service life many times that of a print head consisting of softer and shorter closely spaced electrodes. When the fibers 38 of a print electrode 24 are substantially harder than the matrix 32 of the body 30, the ends of the fibers 38 exposed at the lower surface 36 wear away less rapidly than the matrix 32. This differential wear insures redundant contact of each electrode 24 to the conductive polymer layer 50 of the donor element 14.

It is to be understood that the print head, and the method of fabrication, taught herein are illustrative of the general principles of the invention. Modifications may readily be devised by those skilled in the art without departing from the spirit and scope of the invention.

For example, materials other than silicon for the matrix, and metals other than tantalum and zirconium, may be used within the framework of the invention. Still further, the invention is not restricted to a particular size, shape and spacing of the electrodes 24 or to a particular set of dimensions of the print head 12, or to a particular make of ink donor element 14.

What is claimed is:

1. A print head for a thermal printer comprising:

a print head having a body of relatively non-conductive matrix material, the body having a top surface, a bottom surface and a length;

a plurality of thin closely spaced apart conductive members within the body, the conductive members having top ends and bottom ends, and being arranged essentially parallel to each other at suitable angles to the top and bottom surfaces of the body, the conductive members being formed in situ by directional solidification of one member of a group comprising a eutectic and a near eutectic consisting of very fine metal-like conductive members within the matrix material, the members being highly conductive relative to the matrix material and being laterally insulated and supported by the head body; and a plurality of small-area conductive tabs arranged in closely spaced relation along the length of the top surface of he body of the head, such respective one of the tabs being connected to the upper ends of the conductive members within the area of said each respective one of the tabs the bottom ends of the members being contact an electro-resistive donor element lying against the bottom surface of the head body such that closely spaced electrodes of the print head are formed by multiple of said conductive members connected respectively to the conductive tabs.

2. The print head of claim 1 wherein the conductive tabs are sputtered metal such as cobalt which makes good electrical contact to respective ones of the conductive members.

3. The print head of claim 1 wherein the conductive members are fibers roughly one to three microns in diameter and are spaced apart about three to eight microns.

4. The print head of claim 1 wherein the tabs are about 16 microns square and are arranged along the length of the head body at about 1000 per inch.

5. The print head of claim 1 wherein the conductive members are formed from a group consisting of titanium and zirconium, and the matrix material is silicon.

6. The print head of claim 1 wherein the conductive members have a resistivity of about 35 to 55 micro-ohm cm, and the matrix has a resistivity greater than about one ohm cm.

7. The print head of claim 1 wherein the bottom ends of the conductive members are exposed at the bottom surface of the head body, the members having a hardness of greater than about 1050 kg/mm$^2$.

8. A resistive-ribbon thermal transfer printer comprising:

a print head having a body of a hard solid matrix which is relatively non-conductive and which has a top surface, a bottom surface and a length;

a resistive-ribbon ink donor element mounted in the printer for relative movement past the print head while bearing against it, the donor element, when energized locally with currents, transfer pixels of ink onto a receiver element; and a multitude of electrodes within the print head, the electrodes being closely spaced along and within the length of the matrix body, each of said electrodes comprising a plurality of thin elongated conductors which are generally parallel to each other with top and bottom ends and at suitable angles to the top and bottom surfaces of the matrix, the elongated conductors being fibers of one member of a group consisting of a metal and an intermetallic compound in the matrix and are grown in situ by directional solidification of a group consisting of a eutectic and a near eutectic composition, the elongated conductors being laterally insulated from each other by the matrix body, the bottom ends of the conductors of each of said electrodes serving to inject currents locally into the donor element.

9. The printer of claim 8 wherein the fibers are about one to three microns in diameter and have a length of about 500 microns.

10. A ultra-small electrode for a print head in a thermal printer comprising:

a semiconductor matrix of a material such as silicon;

at least one long thin generally parallel conductor member of a eutectic such as tantalum disilicide ($TaSi_2$) and zirconium disilicide ($ZrSi_2$) and silicon as non-conductive member of the eutectic, the conductor member having two ends and being highly conductive relative to the matrix material and being insulated and supported within the matrix; and an electrical tab connected to one end of the conductor member, the other end of the conductor member makes electrical contact to an electro-resistive ink donor element such that ultra-fine pixels of ink are transferred from the donor element to a receiver element when the electrode is energized with current.

11. The electrode of claim 10 wherein there are a plurality of eutectic conductor members connected in parallel to the electrical tab.

12. A method of forming ultra-fine closely spaced electrodes for a print head of a thermal printer, method comprising the steps of:

growing in situ in a matrix of a material such as silicon, a multitude of thin, closely spaced conductor members by directional solidification of one member of a group comprising a eutectic and a near eutectic of a suitable metal and the matrix material, multiple ones of the conductor members forming respective ones of the ultra-fine electrodes;

finishing the matrix to size and length with a top and a bottom surface at suitable angles to top ends and bottom ends of the conductor members; and applying respective electrical connections for each of said electrodes within small spaced apart areas to multiple top ends of the said conductor members within the respective areas, the bottom ends of the conductor members of each of said electrodes being adapted to electrically contact an electro-resistive ink donor element such that redundant electrical contacts to the donor element are provided for each electrode of the matrix.

13. The method of claim 12 wherein the closely spaced conductor members are grown to a length of about 500 microns.

14. The method of claim 12 wherein the electrical connections are applied to small areas spaced apart along the length of the matrix 1000 per inch.

15. The method of claim 12 wherein the conductor members are grown within the matrix using the Bridgman growth technique.

16. The method of claim 12 wherein the conductor members are grown within the matrix using the Czochralski growth technique.

17. The method of claim 12 wherein the conductor members are grown within the matrix using a crystal growth technique.

* * * * *